US005638896A

United States Patent [19]

Nishino et al.

[11] Patent Number: 5,638,896

[45] Date of Patent: Jun. 17, 1997

[54] COLD-HOT STORAGE BOX WITH INERT GAS INSULATING JACKET

[75] Inventors: Yoshiya Nishino; Kunio Matsuda; Masashi Yamada; Seiichi Ito, all of Tokyo, Japan

[73] Assignee: Nippon Sanso Corporation, Tokyo, Japan

[21] Appl. No.: 522,415

[22] PCT Filed: Jan. 24, 1995

[86] PCT No.: PCT/JP95/00074

§ 371 Date: Sep. 20, 1995

§ 102(e) Date: Sep. 20, 1995

[87] PCT Pub. No.: WO95/21361

PCT Pub. Date: Aug. 10, 1995

[30] Foreign Application Priority Data

Feb. 3, 1994 [JP] Japan ..... 6-11976

[51] Int. Cl.[6] ..... F28D 1/06

[52] U.S. Cl. ..... 165/132; 62/457.1; 62/372; 62/3.6

[58] Field of Search ..... 62/457.1, 457.2, 62/457.7, 457.9, 3.6, 440; 165/132, DIG. 342, DIG. 354; 220/421, 420, 425, 426

[56] References Cited

U.S. PATENT DOCUMENTS

| | | | |
|---|---|---|---|
| 2,059,840 | 11/1936 | Atchison | 62/116 |
| 4,231,228 | 11/1980 | Galvin et al. | 62/298 |
| 4,364,234 | 12/1982 | Reed | 62/3.6 |
| 5,080,146 | 1/1992 | Arasteh | 141/4 |
| 5,165,569 | 11/1992 | Furuhashi et al. | 62/457.4 |

FOREIGN PATENT DOCUMENTS

| | | |
|---|---|---|
| 848292 | 10/1939 | France . |
| 38-8678 | 5/1963 | Japan . |
| 49-18303 | 5/1974 | Japan . |
| 58-49186 | 4/1983 | Japan . |
| 2-3080 | 1/1990 | Japan . |
| 3-18478 | 3/1991 | Japan . |

*Primary Examiner*—John M. Sollecito

*Attorney, Agent, or Firm*—Fish & Richardson P.C.

[57] ABSTRACT

The present invention relates to a cold-hot storage box which can be used as a constant temperature box, a refrigerator for household use, or a freezer, and to a manufacturing method therefor. The cold-hot box of the present invention being characterized by the provision of an insulating container comprising a space of a double walled container made from an inner container and an outer container, enclosing at least one gas having low thermal conductivity selected from the group consisting of xenon, krypton, and argon.

3 Claims, 3 Drawing Sheets

COLD-HOT STORAGE BOX WITH INERT GAS INSULATING JACKET

TECHNICAL FIELD

The present invention relates to a cold-hot storage box which can be used as a constant temperature box, a refrigerator for household use, or a freezer, and to a manufacturing method therefor.

BACKGROUND ART

Generally, cold-hot storage boxes have a box shaped insulating container having an opening, a lid which is freely opened and closed attached to the edge portion of the opening of this insulating container, and a heat exchange apparatus which is attached to at least one of the lid and the insulating container. These insulating container and lid are manufactured using an insulating material. In some cases, as the aforementioned heat exchange apparatus, an electric cooling element, such as a Peltier element, is used. In this Peltier element, heat generation or absorption occurs at contact points by means of connecting different types of conductors or semiconductors and running a direct electric current; one conductor or semiconductor cools, and the other different conductor or semiconductor warms. This is believed to be a phenomenon that occurs because the ratio of the heat flow and electric flow carried by free electrons is not equal on both sides of the conductor or semiconductor. In addition, if the direction of the flow of the direct electric current is reversed, heat generation and absorption become reversed. To improve the temperature maintaining ability of this kind of cold-hot storage box, not only are improvements necessary in the heat exchange ability of the Peltier element, but improvements in the insulating ability of the insulating material are also necessary.

In addition, ordinary refrigerators comprise an insulating container, piping arranged inside this insulating container, a refrigerant gas which flows in this piping, a gas liquefying means for liquefying this refrigerant gas, and a vaporizer for vaporizing this refrigerant gas. In this refrigerator, a refrigerant gas, such as Freon or the like, is condensed or compressed and liquefied by the gas liquefying means; subsequently, the refrigerant gas absorbs the heat of vaporization from inside the insulating container by means of vaporization by the vaporizer, and the inside of the insulating container is cooled. This kind of refrigerator insulating container uses insulation materials.

However, in the insulation materials used by these insulating containers, because foam materials, such as foam urethane, foam styrene, or the like, are used, it is necessary for the thickness of the insulation to be thickly formed so that the insulation has sufficient insulating ability. In particular, when using foam urethane as insulating material, at production time, in order to completely fill the insulation layer with the insulation material, considerable thickness and pressure are needed; thin insulation layers of several millimeters are difficult to manufacture. The ratio between the capacity of the exterior and the storage capacity (inner capacity), in other words, the volumetric capacity, for the resulting insulating container, has the problem that it is low.

In addition, at the time of manufacture of the insulating container, if the foaming does not happen with sufficient control of the pressure, quantity of foam material, etc., the foam urethane does not spread completely, places of inferior insulation arise, and there is the risk that the insulating ability will be reduced. Furthermore, in some cases, Freon, which causes damage to the ozone layer, is used as a foaming material, and this is not desirable from the point of view of the environment.

On the other hand, in some cases, vacuum insulation is used to improve the insulating ability of the insulating material. In this vacuum insulation, the insulating ability of the insulation material is improved, but production costs become high. Furthermore, in the case of vacuum insulation, a sufficient bearing strength is necessary in the insulating container as the load of atmospheric pressure bears upon the insulating container, and there is a problem with limitations on the shape of the insulating container so that the bearing strength can be obtained.

DISCLOSURE OF INVENTION

The invention of the present application provides, as an object, a cold-hot storage box which is superior in insulating ability and volumetric capacity; moreover, its manufacturing costs are low, and it can be formed into any kind of shape desired.

The cold-hot storage box of the present application is a cold-hot storage box having an insulation container which is a double walled container made from an inner container and an outer container which are unitarily joined so as to maintain a space therebetween as an insulation layer; and a heat exchange means which controls the temperature in the insulating container; the cold-hot storage box characterized in that at least one gas having low thermal conductivity selected from the group consisting of xenon, krypton, and argon is enclosed in said space.

In the cold-hot storage box of the present invention, the structure can be such that the aforementioned insulating container is formed into a box shape having an opening, and an insulating lid which can be freely opened and closed attached to the edge portion of the opening of this insulating container.

In addition, the structure can be such that a gas injection pipe sealed at its tip and connected to the aforementioned space is provided in the aforementioned insulation container. In addition, the structure can be such that the gas injection pipe is made from synthetic resin, and its tip is hermetically sealed by an adhesive.

In addition, the structure can be such that an insulation layer filled with the aforementioned gas having low thermal conductivity is provided in the aforementioned lid. In addition, the structure can be such that a gas injection pipe sealed at its tip and connected to the insulation layer is provided in this lid. Furthermore, the structure can be such that the gas injection pipe is made from synthetic resin material and its tip hermetically sealed by an adhesive.

In addition, the structure can be such that evacuation apertures are provided in a recessed manner in the aforementioned insulating container and lid, the aforementioned gas having low thermal conductivity is enclosed in the space provided in said insulating container and lid respectively, and the aforementioned evacuation apertures closed up by sealing plates. Furthermore, the structure can be such that indented portions which will fit the sealing plates are provided around the edges of the aforementioned evacuation apertures, and the sealing plates fitted into these aforementioned indented portions joined by adhesive.

In the cold-hot storage box of the present invention, the structure can be such that the aforementioned insulation layer is multilaminated.

In addition, in the cold-hot storage box of the present invention, the structure can be such that the aforementioned heat exchange means is provided with an electric cooling element, such as a Peltier element; a temperature measuring means for measuring the temperature of the inside of the insulating container; and a control means for controlling the quantity of electric current to the electric cooling element in accordance with data from the aforementioned temperature measuring means.

In the cold-hot storage box of the present invention, the structure can be such that metallic membranes are provided on the inner surface of the aforementioned outer container and the outer surface of the aforementioned inner container.

The manufacturing method for the cold-hot storage box of the present invention, is a method for manufacturing a cold-hot storage box having: an insulation container which is a double walled container made from an inner container and an outer container which are unitarily joined so as to maintain a space therebetween as an insulation layer; and a heat exchange means which controls the temperature in the aforementioned insulating container, characterized by:

(a) a step of accommodating the aforementioned inner container in the aforementioned outer container by unitarily joining the aforementioned inner container to the inside of the aforementioned outer container while maintaining the space to produce a double walled container having a sealable ventilation aperture;

(b) a step of vacuum evacuating the inside of the aforementioned space through the aforementioned evacuation aperture while adjusting the pressure of the surroundings of the double walled container in such a way that the pressure difference between the surroundings of the double walled container and the aforementioned space of the double walled container become small; and subsequently, injecting at least one gas having low thermal conductivity selected from the group consisting of xenon, krypton, and argon in the inside of the aforementioned space through the aforementioned ventilation aperture; and (c) a step of hermetically sealing the aforementioned ventilation aperture and enclosing the gas having low thermal conductivity inside the space to form the insulation layer.

The aforementioned sealable ventilation aperture can be an evacuation aperture which can be hermetically sealed by means of joining a sealing plate, or a gas injection pipe provided on the outer container.

The cold-hot storage box of the invention of the present application, being constructed such that it is provided with an insulating container comprising a space of a double walled container which has been filled with at least one gas having low thermal conductivity selected from the group consisting of xenon, krypton, and argon, gives rise to no unevenness in the insulating ability of the insulating layer, when compared with conventional goods equipped with an insulating layer made from insulating materials; moreover, since the insulating ability of the insulating layer is particularly superior, the insulating ability of the insulating container can be greatly improved. Furthermore, since foam materials using Freon gas which has a damaging effect on the ozone layer are not used, this is desirable from the point of view of the environment. In addition, with regard to the insulation layer filled with gas having low thermal conductivity, since the insulating ability is particularly superior, the volumetric capacity can be improved In addition, when compared with conventional products which use vacuum insulation, because manufacturing can be accomplished by means of easy formation and processing of synthetic resin materials, and because the manufacturing processes are simple, the manufacturing costs of the insulating container can be reduced. In addition, in this insulating container, since the space between inner and outer container is filled with a gas having low thermal conductivity, it is possible to set the bearing pressure of the container lower in comparison to vacuum insulation, and it becomes easy to form various shapes, in particular, box shapes which have flat wall portions and which cause manufacturing problems for conventional goods of vacuum insulation methods.

In addition, in the manufacturing method for the cold-hot storage box of the present invention, when the inside of the space of the double walled container is vacuum evacuated, and then filled up with the gas having low thermal conductivity, because the pressure of the surroundings of the double walled container is adjusted while the evacuation and the injection of the gas having low thermal conductivity takes place, in such a way that the difference in the pressure of the space and the pressure of the surroundings of the double walled layer is small, the necessary bearing strength of the inner container and the outer container can be set smaller. As a result, it is not necessary to form the shape of the inner container and the outer container into structures, such as spheres, or cylinders, which are good at withstanding pressure, and it is therefore possible to manufacture cold-hot storage boxes in any shape. In addition, since the necessary bearing pressure of the inner container and the outer container can be set low, the walls of the insulating container and the walls of the lid can be set fairly thin, and it is possible to manufacture a light weight cold-hot storage box which is suitable for portable use, and moreover has a highly efficient volumetric capacity.

BEST MODE FOR CARRYING OUT THE INVENTION

Figure 1:
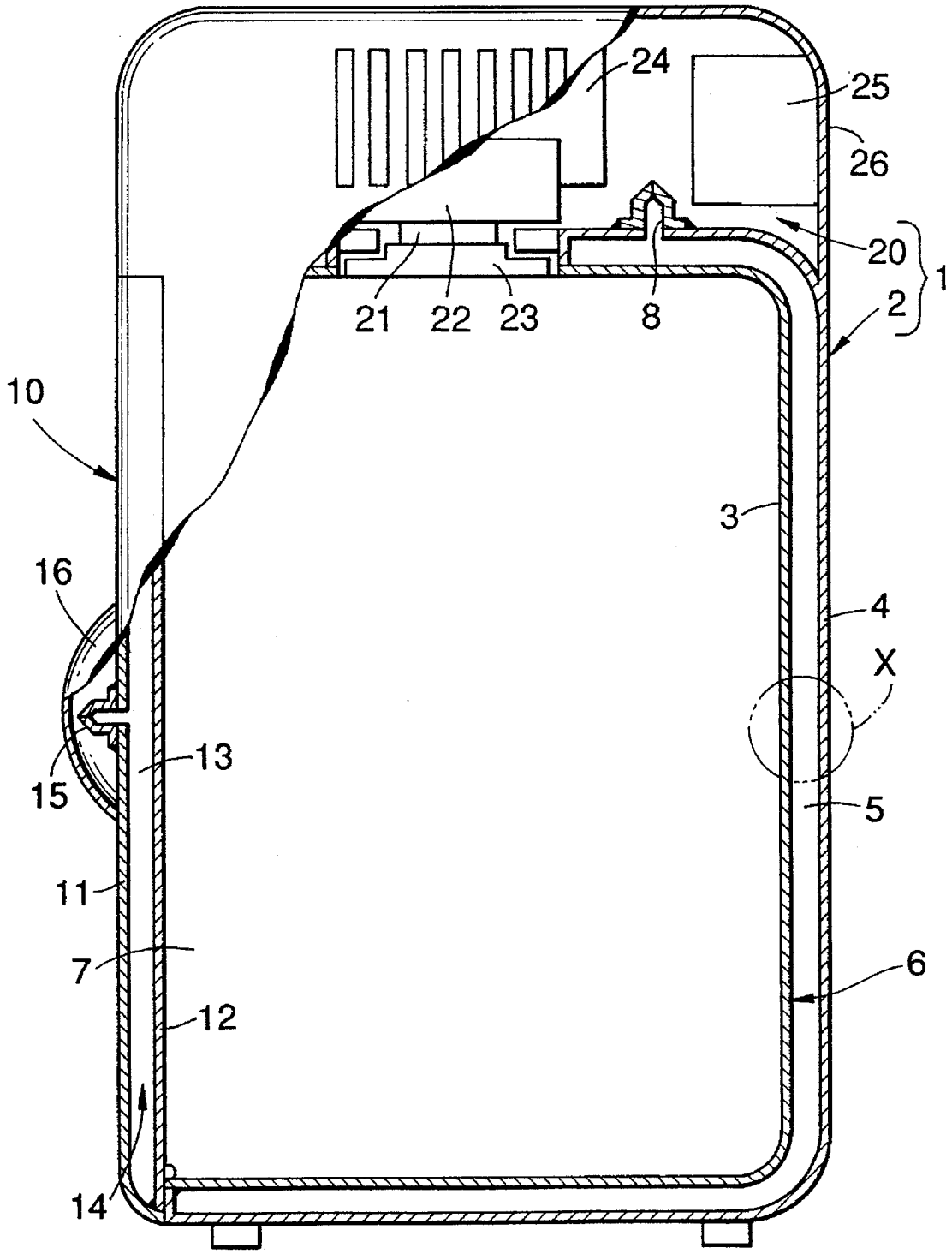
FIG. 1 is a partially cut away frontal view showing an embodiment of the cold-hot storage box of the present invention.

The cold-hot storage box and manufacturing method of Example 1 of the present invention will be explained in detail with reference to FIG. 1. In FIG. 1, 1 is a cold-hot storage box. This cold-hot storage box 1 possesses an insulating container 2 and a heat exchange means 20 for controlling the temperature of the inner portion of insulating container 2. This insulating container 2 has an inner container 3, an outer container 4, which is arranged surrounding inner container 3, metallic membranes 31 and 32, formed on mutually opposing respective surfaces of inner container 3 and outer container 4, and a gas, which fills a space 5 of mutually opposing metallic membranes 31 and 32. Inner container 3 and outer container 4 are unitarily joined at their peripheral edges forming a double-walled container, and an insulation layer 6 is formed by enclosing a gas having low thermal conductivity in the space 5 between inner container 3 and outer container 4. The thickness of the insulation layer 6 is such that it is difficult for the gas having low thermal conductivity to circulate, the preferable aforementioned thickness being in a range of 1~10 mm.

Insulating container 2 is formed from a synthetic resin such as ABS resin, or a metallic material such as stainless steel. It is possible for inner container 3 and outer container 4 to be composed of the same kind of materials, or they can be made of different kinds of materials. The insulating container 2 made from unitarily joining inner container 3 and outer container 4 has a box shaped opening 7 in its side, and a door (lid) 10 which can be freely opened and closed is fitted into the edge portions of opening 7.

Door 10 can be made from synthetic resin such as ABS resin, or a metallic material. Door 10 has an outer panel 11 which is exposed to the outside; an inner panel 12 which is arranged facing outer panel 11; metallic membranes on the surfaces of mutually opposing outer panel 11 and inner panel 12, arranged in the same way as the metallic membranes 31 and 32 of the insulating container 2; and a gas having low thermal conductivity which fills a space 13 between outer panel 11 and inner panel 12. Outer panel 11 and inner panel 12 are unitarily joined at their peripheral edges forming a double walled structure, and by filling space 13 with gas, an insulation layer 14 is formed.

To the outer container 4 of insulating container 2 and the outer panel 11 of the door 10, gas injection pipes 8 and 15 are connected, respectively, so that spaces 5 and 13 can be filled with gas having low thermal conductivity and sealed. Gas injection pipes 8 and 15 are hermetically sealed at their tips, and are made from synthetic resin material such as ABS resin, or metallic materials, in the same way as insulating container 2. When aforementioned gas injection pipes 8 and 15 are made from synthetic resin, the tips of gas injection pipes 8 and 15 can be unitarily joined and hermetically sealed, preferably using a synthetic resin adhesive such as epoxy resin (for example, the product Araldite manufactured by Ciba Geigy), or a sealing method such as heat welding. In particular, to reduce gas penetration, use of a synthetic resin adhesive of an epoxy type to seal the tips of gas injection pipes 8 and 15 is preferable. In that case, the gas injection pipes 8 and 15 can be filled with synthetic resin adhesive and hermetically sealed, the inside of gas injection pipes 8 and 15 can be coated with synthetic resin adhesive, and the gas injection pipes 8 and 15 can be hermetically sealed by pressure. In addition, when gas injection pipes 8 and 15 are made from a metal material, it is preferable that they be unitarily joined by welding or the like, respectively, to outer container 4 and outer panel 11.

Gas injection pipe 8 of insulating container 2 is positioned in the vicinity of heat exchange means 20, and gas injection pipe 15 of door 10 is positioned in the center of the side edge of outer panel 11. The gas injection pipe 15 of door 10 is covered by a knob (cover) 16.

Figure 2:
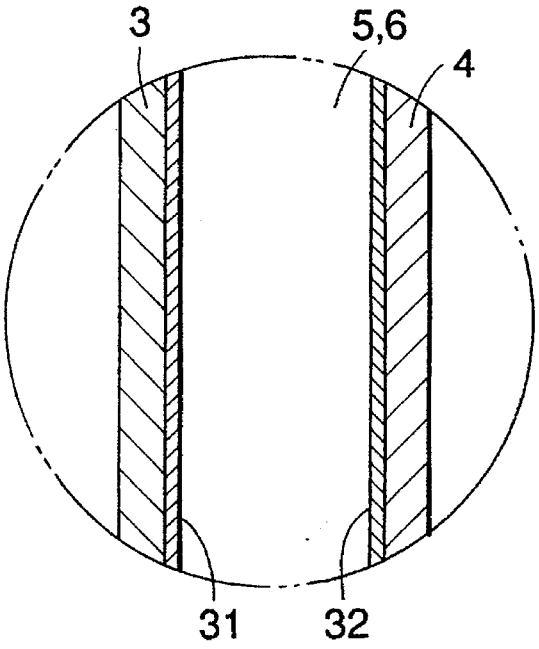
FIG. 2 is an enlarged drawing of the section X of the first drawing.
Figure 3:
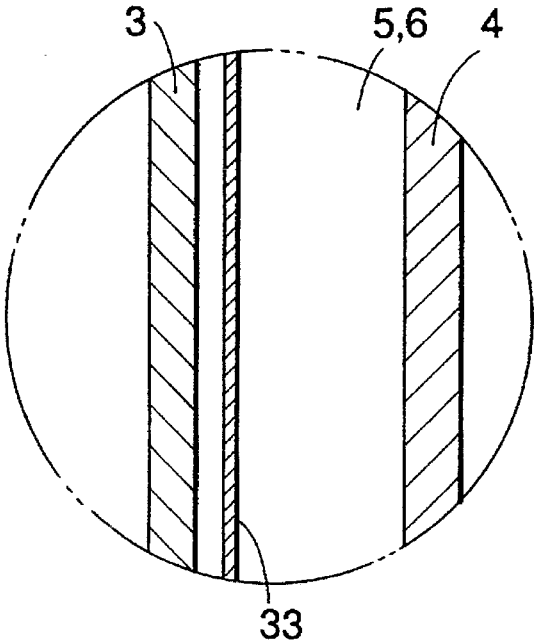
FIG. 3 is an enlargement of the section X showing an alternative of the metallic membrane shown in the second drawing.

FIG. 2 shows the metallic membranes 31 and 32 formed on insulating container 2. The metallic membranes 31 and 32 of insulating container 2, and the same metallic membranes of door 10 are formed by a method of one of vacuum deposition, plating, and adhesion of metallic foil. These metallic membranes 31 and 32 prevent gas permeation, and prevent the radiation of heat. By surrounding the gas having low thermal conductivity with these metallic membranes, the gas having low thermal conductivity is prevented from leaking out. In addition, as shown in FIG. 3, in place of metallic membranes 31 and 32, metallic foil 33 can be arranged between inner container 3 and outer container 4.

As a gas having low thermal conductivity, an inert gas having a heat conductivity lower than air, such as xenon, krypton, argon, or the like, or a mixture of these gases, can be used. At 0° C., the thermal conductivity of air ($\kappa$) is $2.41\times10^{2}$ $W\cdot m^{-1}\cdot K^{-1}$, in contrast, xenon has a thermal conductivity of $0.52\times10^{2}$ $W\cdot m^{-1}\cdot K^{-1}$, krypton has a thermal conductivity of $0.87\times10^{2}$ $W\cdot m^{-1}\cdot K^{-1}$, and argon has a thermal conductivity of $1.63\times10^{2}$ $W\cdot m^{-1}\cdot K^{-1}$. In addition, these gases, unlike Freon gas, do not cause damage to the ozone layer, and their use is desirable for the preservation of the environment.

The injection pressure of the gas having low thermal conductivity is in a range from 600 to 760 mmHg at room temperature (20°~30° C.).

Heat exchange means 20 has an electric cooling element 21, such as a Peltier element; a temperature measuring means for measuring the temperature of the inside of insulating container 2; and a controlling means 25 for controlling the flow of electric current to cooling element 21 in accordance with the data from the aforementioned temperature measuring means. Electric cooling element 21 is made from a conductor or a semiconductor, and has a heat radiating portion 22 arranged on the outside of insulating container 2, and a heat absorbing portion 23, which is made from a different kind of conductor or semiconductor from that used to make heat radiating portion 22, connected to the heat radiating portion 22 and arranged on the inside of insulating container 2. In electric cooling element 21, heat absorbing portion 23 is cooled and heat radiating portion 22 is warmed by means of the flow of direct electric current. In addition, in the vicinity of heat radiating portion 22, a cooling fan 24 is arranged which blows cool air onto heat radiating portion 22. As the aforementioned temperature measuring means, a thermocouple, commercially available temperature sensor, or the like can be used.

The heat exchange means 20 is mounted on the upper part of insulating container 2, and is covered by cover 26 which is integrated with outer container 4. The electric cooling element 21 of heat exchange means 20 is arranged so that it communicates with the inside of the container through an opening in part of insulating container 2. Furthermore, heat exchange means 20 is attached to insulating container 2, but it can also be attached to door 10.

By means of running a direct electric current to electric cooling element 21, heat exchange means 20 absorbs heat from the inside of insulating container 2 by heat absorbing portion 23, and this heat is radiated away by heat radiating portion 22. In this case, the heat radiating effect of heat radiating portion 22 can be improved by the action of cooling fan 24.

In addition to the aforementioned use as a cold storage box, cold-hot storage box 1 can be used as a hot storage box by reversing the direction of the direct electric current flow in electric cooling element 21, making heat absorbing portion 23 a heat radiator which can then keep the inside of the container warm. Furthermore, if the cold-hot storage box 1 is organized in such a way that the flow of direct electric current can be suitably switched, the container can be used as a constant temperature container in which cooling occurs when the temperature of the inside of the container rises above a fixed temperature, and heating occurs when the temperature inside the container falls below a fixed temperature.

Figure 4:
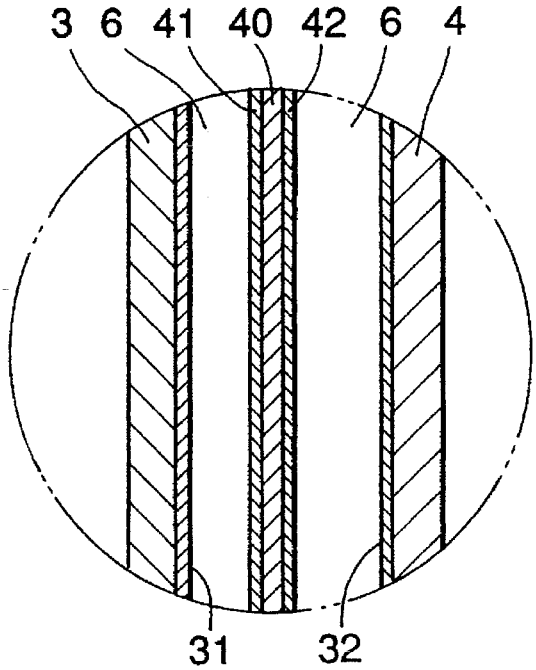
FIG. 4 is an enlargement of the section X showing an alternative example of an insulation layer divided by a dividing material.

In addition, in the aforementioned example, an example is shown in which insulation layer 6 of insulating container 2 and insulation layer 14 of door 10 are, respectively, single layers; however, a multilaminated structure for insulation layers 6 and 14 is also possible. FIG. 4 shows an example in which layer 6 is divided into a plurality of layers by providing a dividing material 40 in between inner container 3 and outer container 4 of insulating container 2. Dividing material 40 can be formed from a thin panel made from a metal, synthetic resin, or the like, and metallic membranes 41 and 42, which are the same as the metallic membranes 31 and 32 of insulating container 2, are formed on both surfaces of dividing material 40. Insulation layer 6 is divided by arranging dividing material 40 in between inner container 3 and outer container 4, by making insulation layer 6 and 14 multilaminated structures, it is possible to improve the heat insulating ability of insulation layers 6 and 14 so that an insulating ability equal to vacuum insulation can be obtained.

In the following, the manufacturing method of the aforementioned cold-hot storage box 1 will be explained.

In manufacturing cold-hot storage box 1, insulating container 2 and door 10 are manufactured first. With regard to insulating container 2, a metallic membrane is formed by means of a vacuum deposition method, a galvanizing (chemical galvanizing, or electrical galvanizing) method, a metallic foil adhesion method, or the like on to the inner surface of outer container 4 and the outer surface of inner container 3, which are composed of synthetic resin or the like. Then, the peripheral edges of inner container 3 and outer container 4 are joined by means of soldering, adhesion by an adhesive, welding, or the like, forming an integrated unit with a space 5 between inner container 3 and outer container 4. Then the integrated double walled container formed from inner container 3 and outer container 4 is put into a chamber.

In this chamber, the air in the chamber and the air inside the space 5 of the double walled container is evacuated. At this time, the pressure is reduced in such a way that excessive force is not exerted on the double walled container, and the difference in the pressure between the pressure inside the chamber and the pressure inside space 5 of the double walled container is made small. Subsequently, when the air pressure inside the chamber reaches about 1/10 of an atmosphere, the vacuum evacuation of the chamber is terminated. In addition, the vacuum evacuation of the space 5 of the double walled container continues, and after the pressure in space 5 reaches the neighborhood of about 10 mmHg, the vacuum evacuation of space 5 is terminated.

Next, space 5 of insulation layer 6 is filled to a predetermined pressure with xenon gas, or the like, from a gas supply tank. At this time, the difference in the pressure between the pressure inside insulation layer 6 and the pressure in the chamber is kept small so that excessive force is not exerted on the double walled container, and while the pressure inside the chamber is gradually returned to atmospheric pressure, insulation layer 6 is filled up with a gas having low thermal conductivity to an injection pressure at a level of 600 to 760 mmHg. When the inside of the chamber has been opened to atmospheric pressure, the gas injection pipe 8, positioned on outer container 4, is hermetically sealed by adhesive filler, pressure, welding, or similar method, thereby forming insulating container 2. After this, the insulating container 2 is removed from the chamber.

By the aforementioned processes, insulation container 2 which has been injected with an inert gas having low thermal conductivity, in which thermal conductivity is small, is produced.

Door 10 is manufactured in the same way as the aforementioned insulating container 2. The outer panel 11 and inner panel 12 of door 10 are prepared, and a metallic membrane is formed on the inner surface of outer panel 11 and on the inner surface of inner panel 12 by means of the same method as that used for the aforementioned inner container 3 and outer container 4, and after the peripheral edges of outer panel 11 and inner panel 12 are joined and integrated, put into a chamber. In this chamber, while the pressure around door 10 is reduced in such a way that excessive pressure is not exerted on door 10, space 13 of door 10 is evacuated. After this, space 13 is filled with a gas having low thermal conductivity through gas injection pipe 15 of door 10, and the pressure of the surroundings of door 10 are gradually returned to atmospheric pressure. Next, gas injection pipe 15 of door 10 is hermetically sealed and door 10 is taken out of the chamber.

In this way, the container 2 and door 10 are constructed, and by mounting heat exchange means 20 onto insulating container 2, the cold-hot storage box 1 is manufactured.

As cold-hot storage box 1 is provided with an insulating container 2, wherein space 5 of the double walled container is filled with at least one gas having low thermal conductivity selected from the group consisting of xenon, krypton, and argon, even when inner and outer container 3 and 4 are made from synthetic resin or the like, the joining portions of inner and outer container 3 and 4 can be prevented from being dissolved by organic gases such as Freon gas. Consequently, inner and outer container 3 and 4 can be manufactured from synthetic resin using simple formation processes, inner and outer container 3 and 4 can be safely maintained, and the construction costs of inner and outer container 3 and 4 can be reduced.

In addition, in insulating container 2, since a gas having low thermal conductivity is injected into the space 5 of the double walled container, the production of unevenness in the insulating ability of the insulation layer is prevented when compared to insulating containers which use existing insulation materials. Furthermore, since foam materials which use Freon which has a damaging effect on the ozone layer are not used, insulation container 2 is good for the environment. In addition, since foam or the like is not injected, the insulation layers need not be thick and can be thinly shaped, and the volumetric capacity of insulating container 2 can be increased.

In addition, when compared to the existing vacuum insulation methods, the manufacturing processes are simple, and because manufacturing can be done by simple formation and processing of synthetic resin materials, manufacturing costs can be reduced. In addition, since a gas having low thermal conductivity has been injected in the space 5 of the double walled container structure of insulating container 2, the pressure bearing strength of the container can be lowered compared with vacuum insulated containers, making it easy for the container to be formed into various shapes, in particular, box shapes having flat walled sections are possible.

Furthermore, since metallic membranes 31 and 32 for preventing both heat radiation and gas penetration have been formed on the inner surface of outer container 4 and the outer surface of inner container 3, steam, oxygen gas, nitrogen gas, and the like cannot infiltrate insulation layer 6, and the gas having low thermal conductivity cannot leak out of insulation layer 6, thus the gas having low thermal conductivity of insulation layer 6 can be maintained for long periods. By having basically the same structure as insulating container 2, door 10 also yields the same results as insulating container 2. Consequently, this cold-hot storage box 1 can maintain a superior insulating ability for long periods.

In addition, in the aforementioned manufacturing method for cold-hot storage box 1, when the pressure inside space 5 of insulating container 2 is reduced, the pressure surrounding insulating container 2 is adjusted so that the difference in the pressure between the pressure in space 5 and the pressure surrounding container 2 is made small; and the difference between the inner pressure and the outer pressure exerted on the walls of inner container 3 and outer container 4 can be made small, thereby making it possible to reduce the necessary bearing pressure for inner container 3 and outer container 4. As a result, it is not necessary to form inner container 3 and outer container 4 into structures which are good for withstanding pressure, such as spheres, or cylinders, and it is possible to manufacture cold-hot storage box 1 in any shape. In addition, since the necessary bearing pressure of inner container 3 and outer container 4 can be set low, the walls of insulating container 2 and the walls of door 10 can be made thin, making it possible to manufacture a light weight cold-hot storage box which is suitable for portable use and has a highly efficient volumetric capacity.

Manufacturing Example

Inner container 3 and outer container 4 of insulating container 2 were made using ABS resin, and onto the outer surface of inner container 3 and the inner surface of outer container 4, a copper galvanizing layer several micrometers thick was formed by means of an electric galvanizing process. Insulating container 2 was made by joining the peripheral edges of inner container 3 and outer container 4 with epoxy resin. This insulating container 2 was put into a chamber, gas injection pipe 8 provided on outer container 4 and the evacuation opening of the chamber were connected to a vacuum pump, the pressure inside space 5 of insulating container 2 and inside the chamber were reduced to 100 mmHg, and the evacuation of the chamber was terminated. Then, the pressure inside of space 5 of insulating container 2 was further evacuated to 0.1 mmHg. After the inside of space 5 had been evacuated to 0.1 mmHg, xenon gas was introduced into space 5 while the pressure of the inside of the chamber was gradually returned to atmospheric pressure. The filled pressure of the xenon of space 5 was 700 mmHg.

After the pressure of the chamber had been returned to atmospheric pressure, the gas injection pipe 8 of insulating container 2 was welded closed using an ultrasonic welder, the xenon gas enclosed in space 5 forming insulation layer 6, and the obtained insulating container 2 was taken out of the chamber.

The temperature maintaining ability of the manufactured insulating container 2 was compared with that of a conventional product which possessed foam urethane as an insulation layer and the results measured. When compared, it was confirmed that insulating container 2, with an insulation layer 6 about ⅓ the thickness of the conventional product, possessed the same temperature maintaining ability as the conventional product.

In addition, since the heat resistance of the foam urethane itself is low, foam urethane can only be used for cold-maintaining containers; however, since the insulating container 2 of the cold-hot storage box 1 obtained by means of the aforementioned manufacturing example uses synthetic resin materials which have high heat resistance, it is not limited to use as a cold maintaining container only, it can also be used as a temperature-maintaining container for maintaining the temperature of boiling water or the like.

In addition, door 10, by having the same structure as insulating container 2, and by being made by means of the same manufacturing method, obtains the same excellent heat maintaining ability and heat resistance as does the aforementioned insulating container 2.

Figure 5:
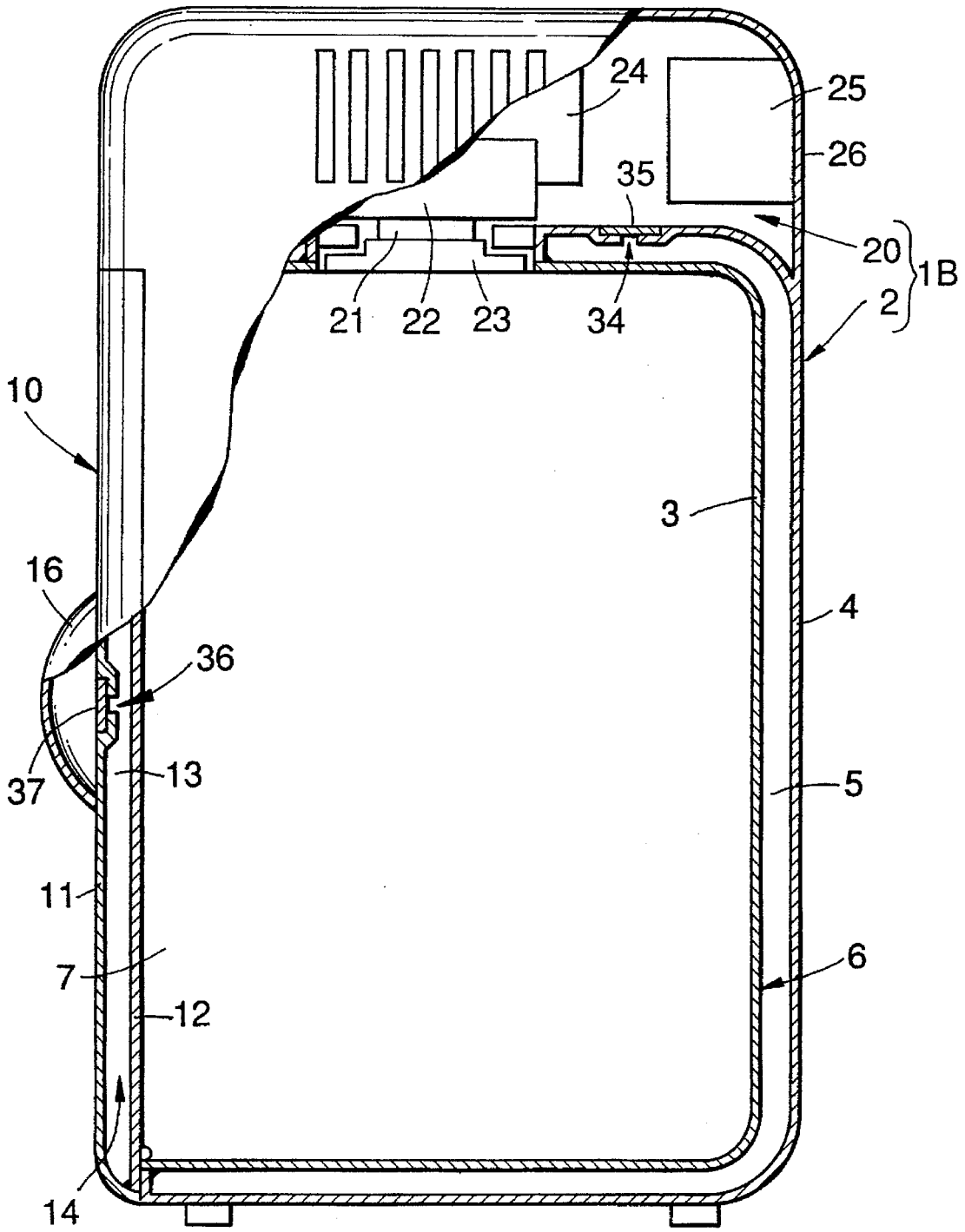
FIG. 5 is a partially cut away frontal view showing another example of the cold-hot storage box of the present invention.

FIG. 5 shows another example of the cold-hot storage box of the present invention. In this example, cold-hot storage box 1B is constructed possessing almost the same structural elements as the cold-hot storage box 1 shown in FIG. 1; those structural elements which are the same have the same number and explanation thereof will be omitted. In the cold-hot storage box 1B of this example, for the purpose of hermetically sealing insulating container 2 and door 10, evacuation apertures 34 and 36 are provided in a recessed manner in outer container 4 of insulating container 2 and outer panel 11 of door 10, respectively. These evacuation apertures 34 and 36 are airtightly blocked by sealing plates 35 and 37.

These evacuation apertures 34 and 36 are preferably from 1 mm to 10 mm in diameter. The peripheral edges of evacuation apertures 34 and 36 are indented portions which are indented toward the inside of outer container 4 and upper panel 11, respectively, so that after sealing plates 35 and 37 are fixed to outer container 4 and outer panel 11, they do not jut out from outer container 4 and outer panel 11. Sealing plates 35 and 37 are the same shape as the indented portions of the peripheral edges of apertures 34 and 36, and fit into these indented portions, and sealing plates 35 and 37 and the indented portions are unitarily joined by means of a joining method such as adhesion by an adhesive, brazing material, and ultrasonic welding.

Sealing plates 35 and 37 can be made from metallic materials, synthetic resins, or the like, preferably using material of the same quality as that of outer container 4 and outer panel 11.

As suitable adhesives for fixing sealing plates 35 and 37, epoxy resin based adhesives and cyanoacrylate-based adhesives can be given.

Cold-hot storage box 1B can be manufactured by basically the same method as cold-hot storage box 1 in the aforementioned manufacturing example. In manufacturing insulating container 2, evacuation aperture 34 is provided in a recessed manner; the peripheral edges of aperture 34 are indented; outer container 4 and inner container 3 are made from metallic materials, synthetic resins, or the like; and metallic membranes 31 and 32 are formed onto the inner surface of outer container 4 and the outer surface of inner container 3. The outer container 4 and inner container 3 on which metallic membranes 31 and 32 have been formed are combined and integrated by joining. Next, the obtained double walled container is put into a chamber, and after the air in space 5 has been evacuated, space 5 is filled with a gas having low thermal conductivity, such as xenon gas, to the level of about atmospheric pressure, sealing plate 35 is fitted into the indented portion which surrounds the edges of evacuation aperture 34, and airtightly joined closing off evacuation aperture 34. By this sealing process, the gas having low thermal conductivity is enclosed in space 5 forming insulation layer 6, and producing insulating container 2. The process of vacuum evacuation of the inside of space 5 of the double walled container and the process of filling space 5 with gas having low thermal conductivity are preferably carried out while adjusting the pressure of the chamber in such a way that the difference between the pressure inside and outside the double walled container is made small.

In the manufacturing method of insulating container 2, various methods can be employed for the sealing process of evacuation aperture 34 by sealing plate 35.

For example, when outer container 4 is made from metallic materials, before the double walled container made by integrating outer container 4 and inner container 3 is put into the chamber, brazing material, such as solder, or the like, is put around the indented portion of the periphery of evacuation aperture 34 and sealing plate 35 put on. After the inside of the chamber and the inside of space 5 of the double walled container are vacuum evacuated, a gas having low thermal conductivity is introduced into the chamber. Alternatively, while air is introduced into the chamber, a gas having low thermal conductivity is introduced only inside space 5. After space 5 has been filled up with the gas having low thermal conductivity, the brazing material provided between sealing plate 35 and the indented portion is heat fused, subsequently cooled, and solidified, thereby unitarily joining sealing plate 35 to the indented portion.

In addition, when outer container 4 is made from synthetic resin material, the double walled container is put into the chamber, and the inside of the chamber and the inside of space 5 of the double walled container are vacuum evacuated. Then, a gas having low thermal conductivity is introduced into the chamber. Alternatively, with packing arranged at the end of a pipe, which is connected with the outside of the chamber, pressed against the peripheral edge of evacuation aperture 34, the double walled container is positioned in the chamber, and after space 5 has been vacuum evacuated through the pipe, space 5 is filled with a gas having low thermal conductivity. After space 5 has been filled with the gas having low thermal conductivity, adhesive is applied to the indented portion of evacuation aperture 34, sealing plate 35 is fitted and joined.

Door 10 is made in the same way as insulating container 2.

Cold-hot storage box 1B of the present example obtains the same results as the aforementioned cold-hot storage box 1, in addition, the connection of extra gas injection pipes 8 and 15 to outer container 4 of insulating container 2 and the outer surface of outer panel 11 of door 10 becomes unnecessary, and extra space and a cover for protecting gas injection pipes 8 and 15 can be omitted, making it possible to design small sized cold-hot storage box. In addition, since it is not necessary to connect gas injection pipes 8 and 15 to outer container 4 of the insulating container and the outer surface of outer panel 11 of door 10, the range of the choice of design and shape for the cold-hot storage box is further increased.

Furthermore, the aforementioned examples are not the only examples of the present invention; it is not possible to mention all possible embodiments. For example, the position and size of door 10 and insulating container 2 can be suitably set up to correspond to the use of the cold-hot storage box.

We claim:

1. A cold-hot storage box comprising:

an insulating container formed into a box having an opening, said container having a double walled structure made from an inner container and an outer container which are unitarily joined so as to maintain a space therebetween as an insulation layer;

an insulating lid having a double walled structure made from an outer panel and an inner panel which are unitarily joined so as to maintain a space therebetween as an insulation layer;

and a heat exchange means which controls the temperature in said insulating container;

wherein an insulating lid can be freely opened and closed and is attached to edge portions of said opening of said insulating container;

wherein at least one gas having low thermal conductivity selected from the group consisting of xenon, krypton, and argon is enclosed in the space provided in said insulating container and lid respectively; and wherein a gas injection pipe is sealed at its tip and connected to said insulation layer and a knob which covers said gas injection pipe is provided on said lid.

2. A cold-hot storage box as recited in claim 1, wherein said gas injection pipe is made from synthetic resin material and its tip is hermetically sealed by an adhesive.

3. A cold-hot storage box comprising:

an insulating container formed into a box having an opening, said container having a double walled structure made from an inner container and an outer container which are unitarily joined so as to maintain a space therebetween as an insulation layer;

an insulating lid having a double walled structure made from an outer panel and an inner panel which are unitarily joined so as to maintain a space therebetween as an insulation layer;

and a heat exchange means which controls the temperature in said insulating container;

wherein an insulating lid can be freely opened and closed and is attached to edge portions of said opening of said insulating container;

wherein at least one gas having low thermal conductivity selected from the group consisting of xenon, krypton, and argon is enclosed in the space provided in said insulating container and lid respectively; and wherein evacuation apertures are provided in a recessed manner in said insulating container and lid, indented portions are provided around the edges of said evacuation apertures, and said evacuation apertures are closed up by sealing plates joined by means of an adhesive into said indented portions.

* * * * *